United States Patent [19]

MacDonald et al.

[11] 4,003,574

[45] * Jan. 18, 1977

[54] GAME BALL

[75] Inventors: Richard A. MacDonald, Delhaven; James A. MacDonald, Villas, both of N.J.; Joseph J. Andrews, Philadelphia, Pa.

[73] Assignee: Thingamajig Corporation, Vineland, N.J.

[ * ] Notice: The portion of the term of this patent subsequent to May 20, 1992, has been disclaimed.

[22] Filed: Mar. 4, 1975

[21] Appl. No.: 555,245

Related U.S. Application Data

[63] Continuation-in-part of Ser. No. 354,935, April 27, 1973, Pat. No. 3,884,466.

[52] U.S. Cl. ..... 273/65 EC; 273/DIG. 20; 273/65 EE; 273/65 EF; 273/65 EG; 46/74 C; 273/106 E

[51] Int. Cl.[2] ..... A63B 41/00

[58] Field of Search ..... 273/65 EE, 65 EC, 199 R, 273/58 C, 106 R, 106.5 R, DIG. 20, 55 R, 106 E; 46/60, 74 A, 74 B, 74 C

[56] References Cited

UNITED STATES PATENTS

| | | | |
|---|---|---|---|
| 1,483,165 | 2/1924 | Eaton | 273/199 R |
| 1,554,781 | 9/1925 | Blecker | 46/60 |
| 1,597,308 | 8/1926 | Brandt | 273/65 EC |
| 1,826,221 | 10/1931 | Pearson | 273/58 C |
| 2,705,148 | 3/1955 | Waller | 273/106 R |
| 3,216,727 | 11/1965 | Hunter | 273/106.5 R X |
| 3,264,776 | 8/1966 | Morrow | 273/106 R X |
| 3,550,940 | 12/1970 | Ball | 273/65 EE |
| 3,884,466 | 5/1975 | MacDonald | 273/65 EC |

*Primary Examiner*—George J. Marlo
*Attorney, Agent, or Firm*—Allan Ratner

[57] ABSTRACT

A football-like game ball which is manually thrown through the air. The ball has a generally truncated ellipsoid outer contour with a Venturi-like nozzle passage extending coincident with a major axis of the ball. A plurality of weighted elements are located within or adjacent to an outer wall of the ball to provide rotational stability when the ball is thrown through the air and spun about the major axis.

10 Claims, 4 Drawing Figures

FIG. 1
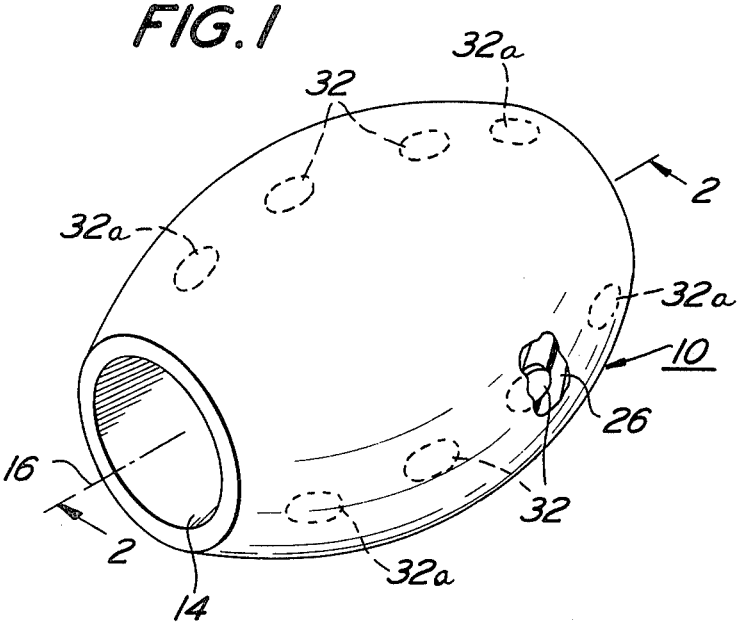
FIG. 2
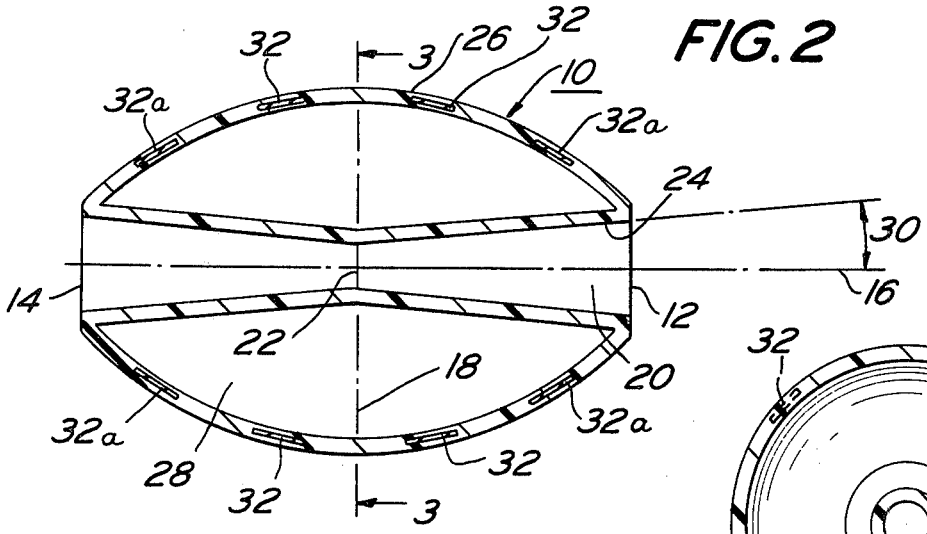
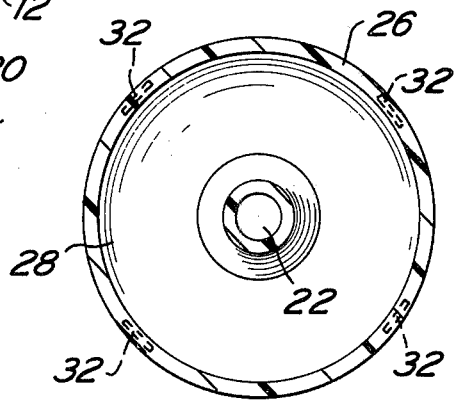
FIG. 3
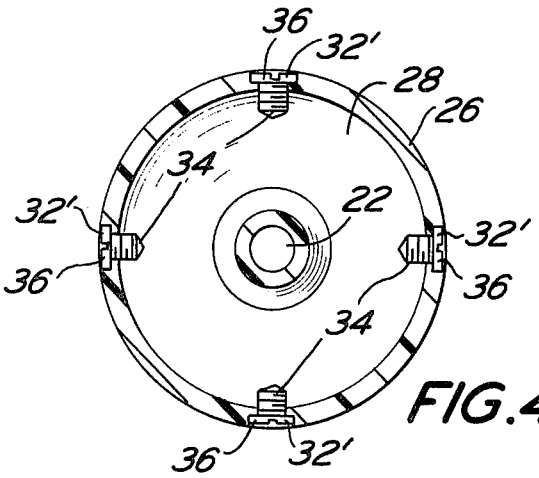
FIG. 4

GAME BALL

CROSS REFERENCE TO RELATED APPLICATION

This is a continuation-in-part of U.S. patent application Ser. No. 354,935 filed Apr. 27, 1973, now U.S. Pat. No. 3,884,466.

BACKGROUND OF THE INVENTION

A. Field of the Invention

This invention pertains to game ball like elements adapted to be thrown through the air. In particular, this invention relates to football-like game balls which have increased rotational stability as well as increased flight path when being thrown through the air.

B. Prior Art

Conventional footballs being generally ellipsoidal in nature, require a great deal of skill when thrown to provide rotational spin as well as to optimize the flight path. Thus, much practice in throwing is necessary to develop the necessary skill. This limits the number of players of the game.

Our copending application, Ser. No. 354,935 filed Apr. 27, 1973 shows an air passage coincidental with a major axis of a truncated ellipsoidal shape so that the flight path of a football may be increased somewhat over a conventional type of football. By providing in general a Venturi-like through passage running coaxial with the major axis of the modified football and making such symmetrical about a minor axis of the football game device, there is effectively achieved further increases in flight path of the football. Additionally, providing a flow cone angle between 2°–25°, the expansion of air through the nozzle passage promotes low turbulence effects and essentially a streamline flow which is believed has to increase the flight path time.

Further weighted elements have been found to provide an optimized rotational stability when these elements are positionally located adjacent to or within an outer wall of the football game device.

SUMMARY OF THE INVENTION

A football adapted to be manually thrown through the air having an oblate spheroid contour. The football is substantially symmetrical about a major and minor axis of the oblate spheroid contour and has a through nozzle passage formed about the major axis. The nozzle passage is further symmetrical in cross-sectional area about the minor axis. In this way, there is provided a maximum cross-sectional nozzle passage area at opposing longitudinal ends of the football and continuously decreasing to a minimum cross-sectional nozzle passage area at substantially a mid-point region between said opposing ends.

BRIEF DESCRIPTION OF THE DRAWINGS

FIG. 1 is a perspective view of a game ball showing a cut out section having weighted elements in an outer wall;

FIG. 2 is a sectional view of the game ball taken along the section lines 2—2 of FIG. 1;

FIG. 3 is a sectional view of the game ball taken along the section lines 3—3 of FIG. 2; and, FIG. 4 is a sectional view of an embodiment of the game ball.

DETAILED DESCRIPTION

Referring now to FIGS. 1–3, there is a shown football or football-like game ball 10 adapted to be manually thrown through the air by a user or player. In overall view, football 10 generally resembles the ellipsoid contour of a standard football which is conventionally used as a game piece.

However, as will hereinafter be described, the improvement modifications made to the standard football has been found to provide increased rotational stability of football-like toy 10 when being passed through the air-like medium. Additionally, as will herein be described, game ball 10 has been found to maintain itself in an airborne condition for a period substantially longer than that found for a conventional football when substantially the same impulse force is applied to both types of game elements.

In overall concept, football 10 has a geometric contour approximating a truncated oblate spheroid or ellipsoid as is clearly shown in FIGS. 1 and 2. Football 10 is further geometrical as well as mass symmetrical about major axis 16 as well as minor axis 18 which passes in a manner substantially normal to major axis 16. Improved game ball 10 is generally extended in a longitudinal direction defined by major axis 16 and terminates at opposing end plane sections 12, 14 respectfully as is shown in FIG. 2. Through nozzle passage 20 formed about major axis 16 passes completely through football 10 and is symmetrical in cross-sectional area when taken about minor axis 18. Nozzle throat section 22 generally lies along minor axis 18 and provides for a minimum cross-sectional area of nozzle passage 20. Thus, as is seen, the nozzle passage cross-sectional area includes a maximum value at opposing ends 12 and 14 of major axis 16 and converges to a minimum cross-sectional area at throat section 22. Further, nozzle passage 20 defines nozzle inner wall 24 which is linearly inclined when taken with respect to the longitudinal extension along major axis 16.

Football outer wall 26 as well as nozzle inner wall 24 may be formed of a generally light weight or low density material such as a plastic material. Additionally, the outer surfaces of walls 24 and 26 may be coated with or formed of a low coefficient of friction material to reduce air drag when football 10 is being thrown through the air. Further, inner closed chamber 28 may be air filled or provided with a light weight material such as a spongy rubber having a low density. This permits football 10 to be easily manipulatable by a wide variety of users to provide ease of handling by youngsters as well as adults.

Empirical experimentation has shown that nozzle passage 20 must be formed in a generally Venturi tube-like contour. This has resulted in the fact that not more than 10.0–20.0% of the difference in pressure between the inlet section 14 and throat section 22 is lost. This is accomplished by the fact that the discharge cone gradually decelerates the flow of air through nozzle passage 20 with a minimum amount of turbulence. Of course, in a standard Venturi tube type nozzle passage, the inlet cone and outlet cone are not necessarily symmetrical in nature. However, in football 10, mass symmetry must be maintained about minor axis 18 to provide for aerodynamic stability as football-like toy 10 is manually thrown through the air. Thus, through empirical data, linearly converging nozzle 20 forms cone angle 30 which lies approximately within the range:

$$\alpha = \left[\cos^{-1}\frac{3l}{D}\right] - \left[\cos^{-1}\frac{4l}{3D}\right] \quad (1)$$

where:

$\alpha$ = cone angle 30 l = ½ × length of major axis $D$ = nozzle diameter at sections 12 or 14

Generally, this has formed cone angle 30 approximately within the range of 2°–25°. As is the general case for Venturi-like passages, throat section 22 has a diameter which generally ranges from one-third to three-fourths of the diameter of end sections 12 and 14. It is believed that the use of the Venturi-like nozzle contour for passage 20 provides for a lowering of drag forces applied to football 10 as well as possibly providing for increased lift through aerofoil-like effects as the incoming air stream passes over a greater distance external to football 10 than when being passed through nozzle passage 20. Although pressure losses are inherently found when nozzle passages are utilized, it is believed that such pressure losses are minimized by the use of Venturi-like passage 20 as is herein described.

Improved football 10, as in the conventional game piece is adapted to be thrown through the air and in general, for proper performance, should be rotated or spun about major axis 16. In order to increase the rotation rate of football 10 and generally maximize the rotational stability it is of importance to increase the moment of inertia of football 10 about major axis 16.

As is generally known, the moment of inertia of football 10 about major axis 16 is generally the sum of the mass of the particles making up football 10 multiplied by the square of the distance from major axis 16.

In order to optimize the moment of inertia increase, a plurality of weighted elements 32 are incorporated into or adjacent football outer wall 26 as is clearly shown in FIGS. 1 and 2. In general, such weighted elements 32 must have a density greater than the material making up the football outer wall 26. Weighted elements 32 which may be disc-like members are positionally disposed in a symmetrical manner about major axis 16 as well as minor axis 18 to provide mass stability when football 10 is being thrown through the air. Weighted elements 32 may be adhesively attached to a surface of outer wall 26, molded therein or otherwise fastened thereto in a number of ways well known in the art.

FIG. 4 describes an embodiment of football 10 where weighted elements 32' are inserted through football outer wall 26. Elements 32' are positioned in a symmetrical manner around major axis 16 in order to provide rotational stability when football 10 is thrown through the air. Additionally, weighted elements 32' are positioned in a symmetric manner with minor axis 18. In the embodiment shown, weights 32' are threadedly secured to football 10 through outer wall 26 and take the form of screw members having threaded sections 34 for engagement with wall 26. Element heads 36 may generally lie in the plane of the outer surface of wall 26 and be formed of a material having a higher density than the material of wall 26 in order to provide the necessary inertia forces to be described in following paragraphs.

Incorporation of weighted elements 32 adjacent to or within an outer wall 26 is of importance since such elements 32 in order to optimize rotational stability, should be placed at a maximum distance from the rotational axis 16. This is clearly shown in the fact that the resultant torque on football 10 when being spun about major axis 16 is provided by the general torque equation (ignoring the masses other than those the weighted elements 32):

$$T = m\, r^2\, \alpha \quad (2)$$

where:

$T$ = torque about axis 16

$m$ = mass of particles 32

$r$ = distance of particles 32 from axis 16

$\alpha$ = angular acceleration about axis 16

This provides for the torque as a function of the rotational mass, the distance from the center rotation, as well as the angular acceleration of the entire system. In general, for rigid bodies consisting of many particles as is the case in football 10, the moment of inertia depends not only upon the entire mass of the body but also upon the distribution of weighted elements 32 of which it is composed. Thus, the resultant torque on football 10 may now be written to include the summation of the weight or masses of disc elements 32 in the following equation:

$$T = \left\{ \sum_{i=1}^{n} m_i\, r_i^2 \right\} \alpha \quad (3)$$

where:

$n$ = numbers of elements 32

$m_i$ = mass of element 2

$r_i$ = distance of element 2 from axis 16

$\alpha$ = angular acceleration about 16

Here the summation sign represents the summation of each of the element 32 masses multiplied by the distance of each mass from major axis 16. The moment of inertia of football 10 as well as any body made up of a number of particles may be consequently shown to equal:

$$I = \sum_{i=1}^{n} m_i\, r_i^2 \quad (4)$$

where:

$I$ = moment of inertia

Thus, combining both equations 4 and 3, it is seen that the torque applied to football 10 may be shown to be equal to:

$$T = I\, \alpha \quad (5)$$

where:

$T$ = torque about axis 16

And further:

$$I = \frac{T}{\alpha} = \sum_{i=1}^{n} m_i\, r_i^2 \quad (6)$$

which shows that the moment of inertia of football-like toy 10 as well as the torque applied is both a function of the mass of various disc elements 32 and the distance squared from the rotational axis 16. Thus, it has been found that to provide maximum rotational stability, disc elements or weighted elements 32 should be placed a maximum distance from rotational axis 16. Due to conventional constraints, this has been found to maximize the moment or the rotational inertia when disc elements 32 are placed within or adjacent to the outer wall 26 of football 10.

As can be clearly seen in FIGS. 1 and 2, other sets 32*a* of weighted elements may be added to increase the rotational moment of inertia about major axis 16. The only restraint being that additional set of weighted elements 32*a* should also be placed symmetrically about major axis 16 as well as minor axis 18. In this manner, there has been found to be an increased rotational efficiency of football-like toy 10 over the conventional football element utilized in a number of sports. Additionally, there has now been found to be an increased distance of flight when the Venturi-type nozzler passage 20 has been incorporated in the overall design.

What is claimed is:

1. A football adapted to be manually thrown through the air, having an oblate spheroid contour being substantially symmetrical about a major and a minor axis of said oblate spheroid contour, said football having a through nozzle passage formed about said major axis, said through nozzle passage being symmetrical in cross-sectional area about said minor axis to provide maximum cross-sectional nozzle passage area at opposing longitudinal ends of said football and continuously decreasing to a minimum cross-sectional nozzle passage area at substantially a mid-point region between said opposing ends.

2. The football as recited in claim 1 where said nozzle passage converges linearly to a minimum cross-sectional area at said minor axis.

3. The football as recited in claim 2 where said linearly converging nozzle through passage forms a cone angle approximately within the range 2° – 25°.

4. The football as recited in claim 2 where said linearly converging nozzle through passage forms a cone angle approximately being within the range:

$$\alpha = \left[\cos^{-1}\frac{3l}{D}\right] - \left[\cos^{-1}\frac{4l}{3D}\right]$$

where:

$\alpha$ = cone angle l = one-half the length of said major axis $D$ = nozzle cross-sectional diameter at opposing ends of said major axis.

5. The football as recited in claim 1 where said through nozzle passage having a minimum diameter at said minor axis, said cross-sectional area of said passage being constant on opposing sides of said minor axis for a distance approximating said minimum diameter of said nozzle passage.

6. The football as recited in claim 1 including means for increasing the moment of inertia of said football about said major axis, said inertia means being disposed symmetrically about said major axis.

7. The football as recited in claim 6 where said inertia means includes a plurality of weighted elements formed within an outer wall of said football.

8. The football as recited in claim 7 where said weighted elements are positionally placed symmetrical about said minor axis.

9. The football as recited in claim 8 where said weighted elements include a set of weighted disc members having a density value in excess of said outer wall of said football.

10. The football as recited in claim 1 where said football includes outer wall surfaces in contact with said air, said outer wall surfaces being generally formed of a plastic material.

* * * * *